United States Patent [19]

Kmiotek et al.

[11] Patent Number: 4,754,932

[45] Date of Patent: Jul. 5, 1988

[54] COAL PULVERIZER INERTING AND FIRE EXTINGUISHING SYSTEM

[75] Inventors: Stanley E. Kmiotek, Enfield; Mark P. Johnson, Windsor; James D. Rogers, Somers, all of Conn.

[73] Assignee: Combustion Engineering, Inc., Windsor, Conn.

[21] Appl. No.: 27,459

[22] Filed: Mar. 18, 1987

[51] Int. Cl.[4] ..... B02C 15/04

[52] U.S. Cl. ..... 241/31; 241/33; 241/101.3; 241/121; 241/DIG. 14

[58] Field of Search ..... 241/117–121, 241/31, 33, 30, 34, 18, 41, 57, DIG. 14, 101.3; 169/45, 46, 47, 54, 60, 61, 26

[56] References Cited

U.S. PATENT DOCUMENTS

| | | | |
|---|---|---|---|
| 3,465,971 | 9/1969 | Dalenberg et al. | 241/119 X |
| 3,912,015 | 10/1975 | Garbee et al. | 241/31 X |
| 4,244,529 | 1/1981 | DeGabriele et al. | 241/DIG. 14 X |

*Primary Examiner*—Mark Rosenbaum

*Attorney, Agent, or Firm*—Arthur E. Fournier, Jr.

[57] ABSTRACT

A combination inerting and fire extinguishing system particularly suited for employment in a pulverizing bowl mill (10) of the type that is operative for effecting the grinding of material and that includes a substantially closed separator body (16) in which a grinding table (18) is supported for rotation relative thereto and a plurality of grinding rolls (22) are also supported therewithin such that the plurality of grinding rolls (22) cooperate with the rotating grinding table (18) to effect a grinding of the material disposed upon the grinding table (18). The subject inerting and fire extinguishing means includes a continuous purging means, a backup inerting means, a pulverizing bowl mill clearing means and a water injection fire suppression means. The continuous purging means is operative during any inerting sequence to cause an inerting medium to flow continually through the pulverizing bowl mill (10) so as to ensure that there is no buildup of volatile gases therewithin. The backup inerting means is operative to provide $CO_2$ inerting when the primary steam inerting system is either not available or for some other reason cannot be utilized. The pulverizing bowl mill clearing means is operative after the pulverizing bowl mill (b 10) has been taken off line to clear the pulverizing bowl mill (10) of its contents via a steam flow so as to render the pulverizing bowl mill (10) ready for restart. The water injection fire suppression means is operative in the event of a fire in the pulverizing bowl mill (10) to accomplish the injection thereinto of water simultaneous with a steam clearing of the interior thereof.

9 Claims, 5 Drawing Sheets

COAL PULVERIZER INERTING AND FIRE EXTINGUISHING SYSTEM

BACKGROUND OF THE INVENTION

This invention relates to apparatus for pulverizing, i.e., grinding, material, and more specifically to an inerting and fire extinguishing system that is particularly suited for employment in a pulverizing bowl mill wherein the inerting and fire extinguishing system is operative to inert a hazardous condition which may be present therewithin and/or to extinguish a fire that may be burning therewithin.

It has long been known in the prior art to provide apparatus employable for purposes of effecting the grinding of materials. More specifically, the prior art is replete with examples of various types of apparatus that have been used heretofore to effect the grinding of a multiplicity of different kinds of materials. In this regard, in many instances discernible differences of a structural nature can be found to exist between individual ones of the aforesaid apparatus. The existence of such differences is, in turn, attributable for the most part to the diverse functional requirements that are associated with the individual applications in which such apparatus are designed to be employed. For instance, in the selection of the particular type of apparatus that is to be utilized for a specific application, one of the principal factors to which consideration must be given is that of the nature of the material that is to be in the apparatus. Coal is one such material wherein there is a need to grind it in order to render it suitable for use in certain applications. Furthermore, fossil fuel fired power generation systems represent one such application in which it is desired to employ coal, as the source of fuel therefor, and wherein a requirement exists to grind, i.e., pulverize the coal to render it suitable for use for this purpose, i.e., for use in a coal-fired power generation system.

For purposes of the discussion that follows, the coal-fired power generation systems referred to above are considered to consist of essentially the following major operating components: a coal feeder, apparatus for pulverizing coal, a distribution system for distributing the coal after the pulverization thereof, a furnace in which the coal is to be burned and the requisite controls for effecting the proper operation of the coal-fired power generation system. Of particular interest herein is that portion of the coal-fired power generation system which has been identified above as the apparatus for pulverizing the coal. Coal pulverizing apparatus are not new. They have been known to exist in the prior art for more than half a century. Furthermore, many improvements in the construction and/or mode of operation of coal pulverizing apparatus have been made during this period.

There are a number of features that it is advantageous for any coal pulverizing apparatus to possess, but particularly those which are designed for employment in a coal-fired power generation system. Reference is had here to features such as reliability, low power consumption, minimum maintenance and wide range of capacity. In addition, such apparatus advantageously should also be characterized by quiet operation, integrated lubrication systems, convenient adjustment and control of coal flow and fineness, and the ability to handle the high temperature air that is required for high moisture coal.

One particular type of coal pulverizing apparatus which is to be found in the prior art that is advantageously characterized by the embodiment therein of the above-recited features is an apparatus most commonly referred to in the industry by the name bowl mill. The latter apparatus obtains its name by virtue of the fact that the pulverization, i.e., grinding, of the coal which takes place therein is effected on a grinding surface that in configuration bears a resemblance to a bowl.

Reference may be had, by way of exemplification, to U.S. Pat. No. 3,465,971, the latter being assigned to the same assignee as the instant application, for a teaching of the nature of the construction and the mode of operation of a prior art form of bowl mill that is suitable for use in a coal-fired power generation system to effectuate the pulverization of the coal that is to be burned as fuel therein. As taught by the aforementioned patent, a bowl mill essentially consists of a body portion in which a grinding table is mounted for rotation, a plurality of grinding rollers that coact with the grinding table to effect the grinding of coal interposed therebetween, coal supply means for feeding to the interior of the bowl mill the coal that is to be pulverized, and air supply means for supplying to the interior of the bowl mill the air required in the operation of the latter. In accordance with the mode of operation of such a bowl mill, the coal, which enters the bowl mill, is pulverized by virtue of the coaction of the grinding rollers with the grinding table. After being pulverized, the coal particles are thrown outwardly by centrifugal force whereby the particles are fed into a stream of air that is entering the bowl mill. The stream of air, which now contains pulverized coal particles, flows through a tortuous path that is established in part by the positioning within the bowl mill of a suitably supported deflector means. As the stream of air and coal particles flows along the aforementioned tortuous path, the sharp turns contained therein effects the separation of the coarse coal particles from the air stream. These coarse coal particles are then suitably returned to the grinding table for further pulverization, while the fine coal particles are carried through the bowl mill in the air stream, and exit therefrom along with the air.

In a conventional coal-fired power generation system, a multiplicity of bowl mills of the type shown in the aforementioned patent would commonly be employed for purposes of satisfying the requirements of the system for pulverized coal. By way of example, the capacity of each of the individual bowl mills might be on the order of one hundred tons per hour of coal.

Although bowl mills constructed in accordance with the teachings of the aforementioned patent have, under actual operating conditions, proven capable of providing adequate performance to date, a need has nevertheless been evidenced for improvements to be made therein. More specifically, prolonged operation of this type of bowl mill has revealed the existence of several conditions of an undesirable nature that can arise during the use thereof. In particular, reference is had here to the fact that it is known that on occasion a hazardous condition may be found to exist where if the hazardous condition is not obviated the possibility exists that the hazardous condition may eventually give rise to the occurrence of an explosion in the bowl mill. Secondly, should a fire occur therewithin if not rapidly extinguished, it could spread to other components of the coal-fired power generation system besides just the bowl mill. Moreover, in view of the relatively high temperatures that are required for purposes of the operation of the bowl mill, fires have been known to occur notwithstanding the fact that no explosion has taken place. A need has, therefore, been evidenced in the prior art for a system that would be suitable for installation in a bowl mill, and which would be operative both to provide an inert atmosphere within the bowl mill whenever a hazardous condition is found to be present therein such as to reduce the potential that an explosion will occur in the bowl mill and to enable a fire to be safely controlled should a fire be detected somewhere within the segment of the coal-fired power generation system that encompasses the bowl mill.

It is, therefore, an object of the present invention to provide a new and improved inerting subsystem suitable for use in a bowl mill of the type that is operative for purposes of effecting the pulverization of a material such as coal.

It is a further object of the present invention to provide a new and improved fire extinguishing subsystem that is suitable for use in combination with the subject inerting subsystem in a bowl mill of the type that is operative for purposes of effecting the pulverization of a material such as coal.

It is another object of the present invention to provide such a combination inerting and fire extinguishing system particularly suited for use in a bowl mill which embodies a continuous purging means that is operative during any inerting sequence to cause an inerting medium to flow continually through the bowl mill so as to ensure that there is no buildup of volatile gases within the bowl mill.

It is still another object of the present invention to provide such a combination inerting and fire extinguishing system particularly suited for use in a bowl mill which embodies a backup inerting means that is operative to provide $CO_2$ inerting when the primary steam inerting system is either not available or for some other reason cannot be utilized.

A further object of the present invention is to provide such a combination inerting and fire extinguishing system particularly suited for use in a bowl mill which embodies a bowl mill clearing means that is operative after the bowl mill has been taken off line to clear the bowl mill of its contents via a steam flow so as to render the bowl mill ready for restart.

A still further object of the present invention is to provide such a combination inerting and fire extinguishing system particularly suited for use in a bowl mill which embodies a water injection fire suppression means that is operative in the event of a fire in the bowl mill to accomplish the injection thereto of water simultaneous with a steam clearing of the interior of the bowl mill.

Yet a further object of the present invention is to provide such a combination inerting and fire extinguishing system particularly suited for use in a bowl mill that is capable of either manual operation or automatic operation.

Yet another object of the present invention is to provide such a combination inerting and fire extinguishing system which is suitable for employment in newly constructed bowl mills as well as being equally suitable for employment in retrofit applications.

Yet still another object of the present invention is to provide such a combination inerting and fire extinguishing system particularly suited for use in a bowl mill which is advantageously characterized both by its ease of manufacture and its ease of installation in a bowl mill, while yet being relatively inexpensive to provide.

SUMMARY OF THE INVENTION

In accordance with the present invention there is provided a combination inerting and fire extinguishing system that is particularly suited for employment in a bowl mill of the type that is operative for purposes of effecting the pulverization therewithin of a material such as coal. The subject inerting and fire extinguishing system includes a continuous purging means operative during any inerting sequence to cause an inerting medium to flow continually through the bowl mill so as to ensure that there is not a buildup of volatile gases within the bowl mill, a backup inerting means operative to provide $CO_2$ inerting when the primary steam inerting system is either not available or for some other reason cannot be utilized, a bowl mill clearing means operative after the bowl mill has been taken off line to clear the bowl mill of its contents via a steam flow so as to render the bowl mill ready for restart, and a water injection fire suppression means operative in the event of a fire in the bowl mill to accomplish the injection into the bowl mill of water simultaneous with a steam clearing of the interior of the bowl mill. To this end, the subject inerting and fire extinguishing system is composed of an inerting subsystem and a fire extinguishing subsystem. The inerting subsystem in turn includes inerting inlet means suitably provided on the bowl mill so as to be operative for supplying an inerting medium into the interior of the bowl mill, an inerting medium supply means connected in fluid flow relation to the inerting inlet means operative for supplying an inerting medium to the inerting inlet means and therethrough into the interior of the bowl mill, a no coal flow detection means suitably mounted on the coal supply means of the bowl mill so as to be operative to detect the absence of coal flow in the coal supply means and to provide a signal indicative of such a lack of coal flow in the coal supply means, receiving means connected in circuit relation with the no coal flow detection means for receiving the signal generated thereby, and control means connected in fluid flow relation with the inerting medium supply means so as to be operative for initiating the flow of the inerting medium to the inerting inlet means and therethrough into the interior of the bowl mill so as to establish an inert atmosphere within the bowl mill when a lack of coal flow in the coal supply means is detected by the no coal flow detection means. The fire extinguishing subsystem, on the other hand, includes fire extinguishing inlet means suitably provided on the bowl mill so as to be operative for supplying a fire extinguishing medium into the interior of the bowl mill, a fire extinguishing medium supply means connected in fluid flow relation to the fire extinguishing inlet means operative for supplying a fire extinguishing medium to the fire extinguishing inlet means and therethrough into the interior of the bowl mill, temperature detection means suitably positioned on the bowl mill so as to be operative to detect the temperature at the location whereat the temperature detection means is positioned and so as to be operative to provide as an indication thereof a signal when the temperature detected thereby is found to exceed a certain level, receiving means connected in circuit relation with the temperature detection means for receiving therefrom the signal generated thereby, and control means connected in fluid flow relation with the fire extinguishing medium supply means so as to be operative for initiating the flow of the fire extinguishing medium to the fire extinguishing inlet means and therethrough into the interior of the bowl mill so as to effectuate a reduction in the level of the temperature that occasioned a need for the flow of fire extinguishing medium into the interior of the bowl mill.

DESCRIPTION OF A PREFERRED EMBODIMENT

Figure 1:
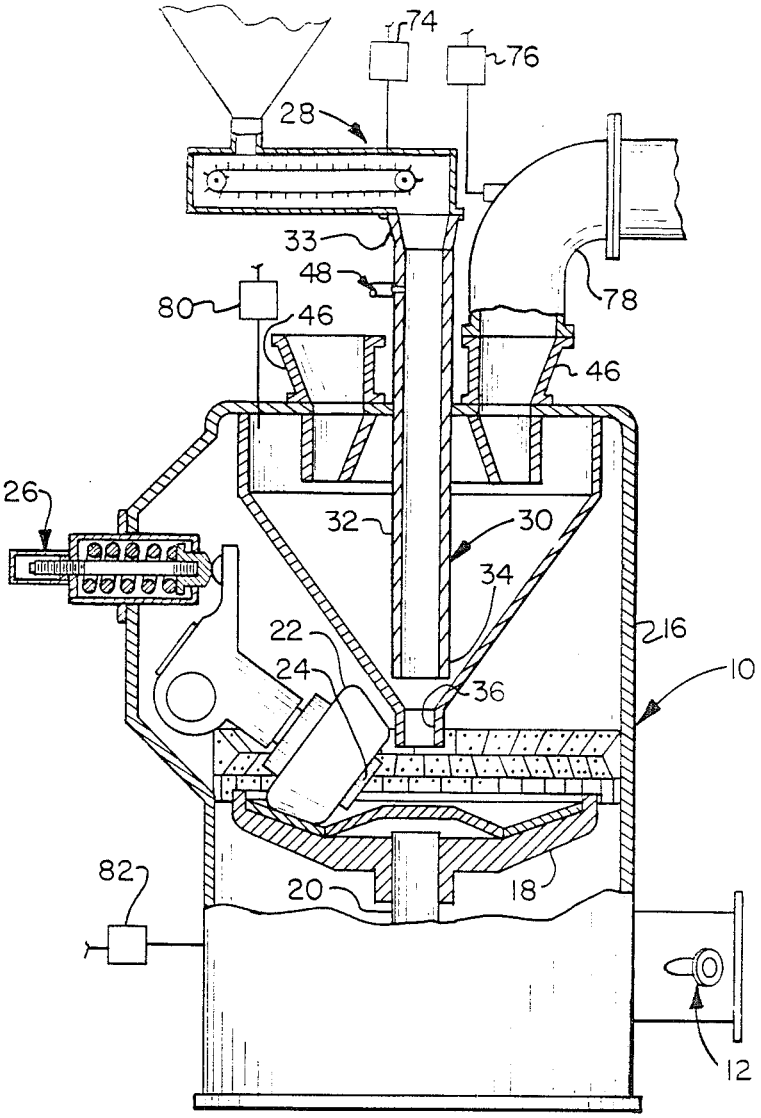
FIG. 1 is a side elevational view partially in section of a pulverizer bowl mill embodying a combination inerting and fire extinguishing system constructed in accordance with the present invention and with the inerting subsystem segment thereof being illustrated in particular therein.
Figure 2:
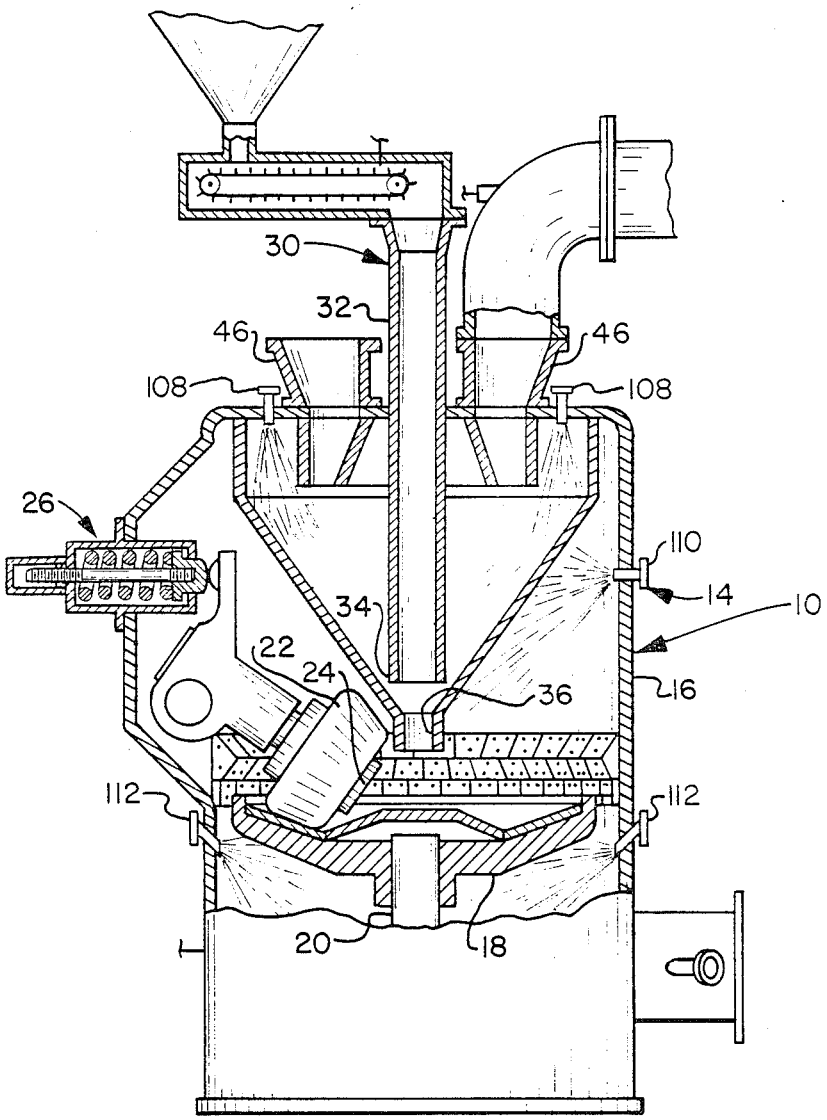
FIG. 2 is a side elevational view partially in section of a pulverizer bowl mill embodying a combination inerting and fire extinguishing system constructed in accordance with the present invention and with the fire extinguishing subsystem segment thereof being illustrated in particular therein.

Referring now to the drawing, and more particularly to FIGS. 1 and 2 thereof, there is depicted therein a bowl mill, generally designated by reference numeral 10. Inasmuch as the nature of the construction and the mode of operation of bowl mills per se are well-known to those skilled in the art, it is not deemed necessary, therefore, to set forth herein a detailed description of the bowl mill 10 illustrated in FIGS. 1 and 2. Rather, for purposes of obtaining an understanding of a bowl mill 10 which is capable of having cooperatively associated therewith a combination inerting and fire extinguishing system, the latter being composed of an inerting subsystem generally designated by the reference numeral 12 in FIG. 1 of the drawing and of a fire extinguishing subsystem generally designated by the reference numeral 14 in FIG. 2 of the drawing, that in accordance with the present invention is capable of being installed therein and when installed therein the inerting subsystem 12 is operative to provide an inert atmosphere within the bowl mill 10 whenever a hazardous condition is found to be present therein such as to reduce the potential that an explosion will occur in the bowl mill 10 while the fire extinguishing subsystem 14 is operative to enable a fire to be safely controlled should one be detected, it is deemed sufficient that there be presented herein merely a description of the nature of the components of the bowl mill 10 with which the aforesaid combination inerting and fire extinguishing system cooperates. For a more detailed description of the nature of the construction and the mode of operation of the components of the bowl mill 10, which are not described in detail herein, one may have reference to the prior art, e.g., U.S. Pat. No. 3,465,971, which issued Sept. 9, 1966 to J. F. Dalenberg et al, and/or U.S. Pat. No. 4,002,299, which issued Jan. 11, 1977 to C. J. Skalka.

Referring further to FIGS. 1 and 2 of the drawing, the bowl mill 10 as illustrated therein includes a substantially closed separator body 16. A grinding table 18 is mounted on a shaft 20, which in turn is operatively connected to a suitable drive mechanism (not shown) so as to be capable of being rotatably driven thereby. With the aforereferenced components arranged within the separator body 16 in the manner depicted in FIGS. I and 2 of the drawing, the grinding table 18 is designed to be driven in a clockwise direction.

Continuing with a description of the bowl mill 10, a plurality of grinding, i.e., pulverizer, rolls 22, preferably three in number in accord with conventional practice, are suitably supported within the interior of the separator body 16 so as to be spaced equidistantly one from another around the circumference of the latter. Note is made here of the fact that in the interest of maintaining clarity of illustration in the drawing only one grinding roll has been depicted in each of FIGS. 1 and 2 of the drawing.

With further regard to the grinding rolls of the bowl mill 10, each of the latter as best understood with reference to the grinding roll 22 depicted in each of FIGS. 1 and 2 of the drawing is preferably supported on a suitable shaft, seen at 24 in FIGS. 1 and 2, for rotation relative thereto. In addition, each of the grinding rolls, as best understood with reference to the grinding roll 22 of FIGS. 1 and 2 is also suitably supported for movement relative to the upper surface, as viewed with reference to FIGS. 1 and 2, of the grinding table 18. To this end, each of the grinding rolls of the bowl mill 10 including the roll 22 illustrated in FIGS. 1 and 2 has a spring means, generally designated in FIGS. 1 and 2 by the reference numeral 26, cooperatively associated therewith. The spring means 26, in a manner well-known to those skilled in the art of bowl mills, is operative to establish a spring loading on the grinding roll 22 associated therewith whereby the latter grinding roll 22 is made to exert the requisite degree of force on the coal that is disposed on the grinding table 18 for purposes of accomplishing the desired pulverization of this coal. One spring means, which is suitable for use as the spring means 26 in the bowl mill 10 of FIGS. 1 and 2 of the drawing, forms the subject matter of copending U.S. patent application Ser. No. 765,976 that was filed on Aug. 15, 1985 in the names of Robert S. Prairie and Frank J. Paskowski, and that is assigned the same assignee as the present application, and which issued as U.S. Pat. No. 4,706,900 on Nov. 17, 1987.

The material, e.g., coal, that is to be pulverized in the bowl mill 10 is fed thereto by means of any suitable conventional form of feed means. By way of exemplification in this regard, one such feed means that may be employed for this purpose is a belt feeder means such as the belt feeder means which is depicted schematically in FIG. 1 of the drawing and wherein the belt feeder means is generally designated by the reference numeral 28. Upon being discharged from the belt feeder means 8, the coal enters the bowl mill 10 by means of a coal supply means, generally designated by reference numeral 30, with which the separator body 16 is suitably provided. In accordance with the embodiment of the bowl mill 10 illustrated in both FIGS. 1 and 2 of the drawing, the coal supply means 30 includes a suitably dimensioned duct 32 having one end thereof which extends outwardly of the separator body 16 and which is suitably shaped as seen at 33 in FIG. 1 of the drawing so as to facilitate the collection of the coal particles leaving the belt feeder means 28, and the guiding thereafter of these coal particles into the duct 32. The other end 34 of the duct 32 of the coal supply means 30 is operative to effect the discharge of the coal on to the surface of the grinding table 18. To this end, as shown in both FIGS. 1 and 2 of the drawing, the duct end 4 preferably is suitably supported within the separator body 6 through the use of any suitable form of conventional support means (not shown) such that the duct end 34 is coaxially aligned with the shaft 20 that supports the grinding table 18 for rotation, and is located in spaced relation to a suitable outlet 36 provided in the classifier, generally designated by reference numeral 38, through which the coal flows in the course of being fed on to the surface of the grinding table 18.

In accord with the mode of operation of the bowl mills that embody the form of construction depicted in each of FIGS. 1 and 2 of the drawing, a gas such as air is utilized to effect the conveyance of the coal from the grinding table 18 through the interior of the separator body 16 for discharge from the bowl mill 10. The air that is used in this regard enters the separator body 16 through a duct, denoted by the reference numeral 40 in both FIGS. 1 and 2 of the drawing, that is cooperatively associated with the bowl mill 10 so as to be usable for such a purpose. From the duct 40 the air flows into the separator body 16 and through the annulus, the latter being denoted in FIG. 1 by the reference numeral 42, which consists of the ring-like space that exists between the circumference of the grinding table 18 and the inner wall surface of the separator body 16. The air upon passing through the annulus 42 is deflected over the grinding table 18 preferably by means of a vane wheel assembly, constructed in accordance with the teachings of U.S. Pat. No. 4,523,721 which issued on June 18, 1985 to T. V. Maliszewski et al, and which is assigned to the same assignee as the present application. For purposes of maintaining clarity of illustration in the drawing, only the deflector portion, the latter being seen at 44 in each of FIGS. 1 and 2 of the drawing, of the vane wheel assembly which forms the subject matter of U.S. Pat. No. 4,523,721 has been depicted in the drawing. Moreover, it is deemed that the depiction of the deflector portion 44 in each of FIGS. 1 and 2 of the drawing is sufficient for purposes of enabling one to obtain a complete understanding of the subject matter of the present invention to which the instant application is directed. However, should further information be desired concerning the nature of the construction and/or the mode of operation of the vane wheel assembly that the bowl mill 10, which is shown in each of FIGS. 1 and 2, embodies, reference maybe had for this purpose to U.S. Pat. No. 4,523,721.

While the air is flowing along the path described above, the coal which is disposed on the surface of the grinding table 18 is being pulverized by the action of the grinding rolls 22. As the coal becomes pulverized, the particles are thrown outwardly by centrifugal force away from the center of the grinding table 18. Upon reaching the region of the circumference of the grinding table 18, the coal particles are picked up by the air exiting from the annulus 42 and are carried along therewith. The combined flow of air and coal particles is thereafter captured by the deflector portion 44 of the vane wheel assembly constructed in accordance with the teachings of U.S. Pat. No. 4,523,721. The effect of this is to cause the combined flow of this air and coal particles to be deflected over the grinding table 18. This necessitates a change in direction of the path of flow of this combined stream of air and coal particles. In the course of effecting this change of direction, the heaviest coal particles, because they have more inertia, become separated from the air stream, and fall back on to the surface of the grinding table 18 whereupon they undergo further pulverization. The lighter coal particles, on the other hand, because they have less inertia continue to be carried along in the air stream.

After leaving the influence of the aforesaid deflector portion 44 of the vane wheel assembly constructed in accordance with the teachings of U.S. Pat. No. 4,523,721, the combined stream consisting of air and those coal particles that remain flow to the classifier 38 to which mention has previously been had hereinbefore. The classifier 38, in accord with conventional practice and in a manner which is well-known to those skilled in this art, operates to effect a further sorting of the coal particles that remain in the air stream. Namely, those particles of pulverized coal, which are of the desired particle size, pass through the classifier 38 and along with the air are disharged therefrom and thereby from the bowl mill 10 through the outlets 46 with which the latter is provided for this purpose. On the other hand, those coal particles which in size are larger than desired are returned to the surface of the grinding table 18 whereupon they undergo further pulverization. Thereafter, these coal particles are subjected to a repeat of the process described above.

With further regard to the matter of the pulverizing, i.e., grinding, action to which the coal disposed on the grinding table 18 is subjected by the grinding rolls 22, the amount of force that must be exerted by the latter in order to effect the desired degree of pulverization of the coal will vary depending on a number of factors. For example, one important consideration in this regard is the nature of the coal itself. That is, the amount of force required to pulverize the coal will be a function of the grindability of the coal to be pulverized, i.e., the grinding characteristics of the latter. Another important factor in determining the amount of force that the grinding rolls 22 must exert to accomplish the desired degree of pulverization of the coal is the depth to which the coal is disposed on the grinding table 18, which in turn is a function of the output rate at which the bowl mill is being operated.

Reference will now be had particularly to FIGS. 1 and 2 of the drawing for purposes of describing the combination inerting and fire extinguishing system which in accordance with the present invention is designed to be cooperatively associated with a bowl mill constructed in the manner of the bowl mill 10 that is depicted in each of FIGS. 1 and 2 of the drawing. More specifically, the combination inerting and fire extinguishing system which in accord with the present invention is composed of an inerting subsystem, generally designated by the reference numeral 12 in FIG. 1 of the drawing, and a fire extinguishing subsystem, generally designated by the reference numeral 14 in FIG. 2 of the drawing, is designed to be installed in a bowl mill such as the bowl mill 10 of FIGS. 1 and 2 of the drawing such that when so installed the inerting subsystem 12 is operative to provide an inert atmosphere within the bowl mill 10 whenever a hazardous condition is detected to be present therein thereby reducing the potential for explosion in the bowl mill 10 and the fire extinguishing subsystem 14 is operative to enable a fire to be safely controlled should one be found to exist.

First, there will be set forth herein a description of the nature of the construction of the inerting subsystem 12 segment of the combination inerting and fire extinguishing system constructed in accordance with the present invention. For this purpose, reference will be had in particular to FIGS. 1, 3 and 5 of the drawing. With reference thus to FIG. 1 of the drawing, the inerting subsystem 12 includes a no coal flow detector means, the latter being denoted generally in the drawing by the reference numeral 48. As best understood with reference to FIG. 1 of the drawing the no coal flow detector means 48 is designed to be mounted on the coal supply means 30, i.e., the duct 32, so as to be positioned therealong at a location which is external of the separator body 16 of the bowl mill 10. The function of the no coal flow detector means 48, as the name thereof implies, is to detect the absence of coal flowing through the duct 32 from the belt feeder means 28 to the grinding table 18, i.e., an interruption in coal feed to the grinding table 18. Any conventionally available device that is suitable for use for such a purpose may be employed as the no coal flow detector means 48 in the inerting system 12 of the combination inerting and fire extinguishing system of the present invention. To this end, the specific manner in which the detection of the absence of coal flow in the duct 32 is accomplished, be it through optical measurements, pressure measurements, etc., is not important. Instead, what is important is that the device which is employed as the no coal flow detector means 48 in the inerting subsystem 12 be capable of detecting accurately and reliably when an interruption occurs in the feed of coal through the duct 32 to the grinding table 18.

Upon detecting the absence of coal flow in the duct 32, the no coal flow detector means 48 is designed to be operative to generate a signal that is indicative of this fact; namely, that an interruption in coal flow through the duct 32 has occurred. This signal provided by the no coal flow detector means 48 in turn is then transmitted to receiving means, the latter being generally denoted by the reference numeral 50 in FIG. 5 of the drawing, to which the no coal flow detector means 48 is suitably connected in circuit relation as seen at 52 in FIG. 5 of the drawing. The receiving means 50 upon receiving the signal from the no coal flow detector means 48 is designed to be operative to provide an audio and/or visual indication of the fact that there is an absence of coal flow through the duct 32. This audio indication may take the form of an alarm sounding, etc. Similarly, the visual indication may take the form of a light flashing, etc.

Any conventional form of audio and/or visual indicating means suitable for use for purposes of calling a plant operator's attention to the hazardous condition which has been detected by the no coal flow detector means 48, i.e., the absence of coal flow in the duct 32, may be cooperatively associated as part of the receiving means 50 so as to be automatically activated upon receipt by the receiving means 50 of a signal from the no coal flow detector means 48 indicating the lack of coal flow in the duct 32. In addition, the receiving means 50 is designed also to be operative to itself generate a signal which in turn is intended to be transmitted to a valve control means, the latter being generally denoted by the reference numeral 54 in FIG. 5 of the drawing, to which the receiving means 50 is suitably connected in circuit relation as shown schematically at 56 in FIG. 5. To thus summarize, receiving means 50 is intended to be operative to receive a signal from the no coal flow detector means 48 and in response to receipt thereby of such a signal is designed to be operative both to provide an audio and/or visual indication suitable for calling an operator's attention to the fact that such a signal has been received by the receiving means 50 from the no coal flow detector means 48 and to generate a signal for transmission to the valve control means 54 for a purpose yet to be described. As such, the receiving means 50 may take the form of any suitable conventional type of controller device which is commercially available presently and which is capable of being operated in the aforedescribed fashion.

Figure 3:
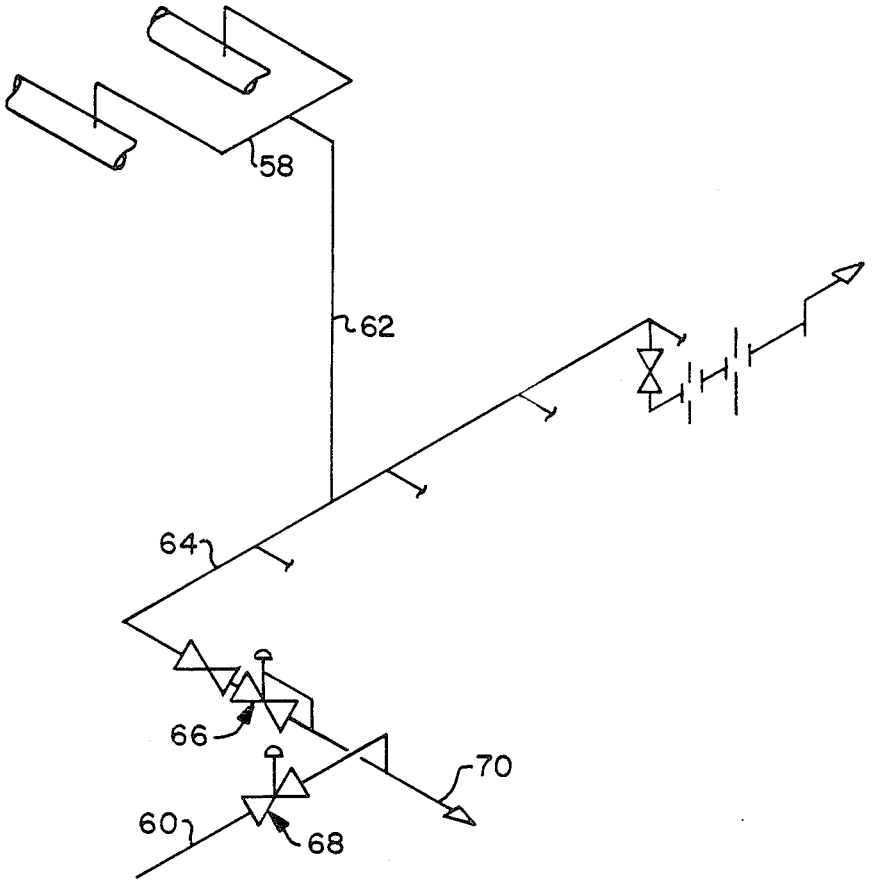
FIG. 3 is a schematic fluid flow diagram for the inerting subsystem segment of the combination inerting and fire extinguishing system constructed in accordance with the present invention illustrating the flow path that the inerting medium follows in flowing from the supply source of the inerting medium to the pulverizer bowl mill.
Figure 5:
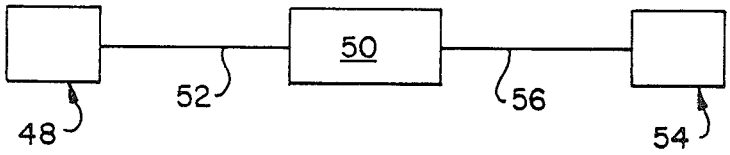
FIG. 5 is a schematic representation of the control portion of the inert subsystem segment of the combination inerting and fire extinguishing system constructed in accordance with the present invention illustrating the manner in which the bowl mill and the supply source of the inerting medium are interconnected one to another for control purposes.

Continuing with the description of the inerting subsystem 12 constructed as depicted in FIGS. 1, 3 and 5 of the drawing, in accord with the illustrated embodiment of the invention the inerting subsystem 12 further includes a first inerting medium supply source, the latter being depicted schematically at 58 in FIG. 3 of the drawing, and a second inerting medium supply source, the latter being identified by the reference numeral 60 in FIG. 3 of the drawing. In accord with the best mode embodiment of the invention the first inerting medium preferably consists of steam and the second inerting medium preferably consists of $CO_2$ or $N_2$. With further reference to FIG. 3 of the drawing, the steam supply source 58 as depicted therein is connected in fluid flow relation by means of a series of pipes which are schematically illustrated in FIG. 3 wherein this piping is identified by the reference numerals 62 and 64, respectively, to a valve means, the latter being denoted generally in FIG. 3 by the reference numeral 66. The valve means 66 as will be discussed more fully hereinafter is suitably connected in circuit relation with the valve control means 54, to which reference has been had hereinbefore such that the operation of the valve means 66 is controlled by means of the valve control means 54.

Similarly, as best understood with reference to FIG. 3 of the drawing, the $CO_2$ supply source 60 in turn is connected in fluid flow relation to a valve means, generally designated in FIG. 3 by the reference numeral 68. The valve means 68 like the previously described valve means 66 for a purpose which will be described more fully hereinafter is suitably connected in circuit relation with the valve control means 54 such that the operation of the valve means 66 is capable of being controlled by means of the valve control means 54. Lastly, both the valve means 66 and the valve means 68 are connected in fluid flow relation by suitable piping, the latter being shown schematically at 70 in FIG. 3 of the drawing, to the bowl mill 10. More specifically, the valve means 66 and the valve means 68 are each connected by means of the piping 70 to an inerting medium inlet, the latter being denoted generally by the reference numeral 72 in FIG. 1 of the drawing. The inerting medium inlet 72 is designed to serve as a flow passage into the the interior of the bowl mill 10 for the inerting medium, be the inerting medium steam, $CO_2$ or $N_2$. As best understood with reference to FIG. 1 of the drawing, the inerting medium inlet 72 preferably is suitably located on the duct 40, the latter comprising the means through which the air that transports the coal particles through the bowl mill 10 enters the latter.

Next, there will be set forth herein a description of the nature of the construction of the fire extinguishing system 14 segment of the combination inerting and fire extinguishing system constructed in accordance with the present invention. For this purpose, reference will be had in particular to FIG. 2, 4 and 6 of the drawing. With reference thus to FIG. 2 of the drawing, the fire extinguishing subsystem 14 includes a plurality of temperature detection means, each operative to detect the temperature at the location whereat the particular one of the plurality of temperature detection means is positioned. Moreover, each of the plurality of temperature detection means is designed to be operative to generate a signal when the temperature detected thereby reaches or exceeds a predetermined level as an indication thereof. More specifically, the plurality of temperature detection means, as will be best understood with reference in particular to both FIGS. 1 and 6 of the drawing, includes a first temperature detection means denoted by the reference numeral 74 in the drawing that is suitably mounted in juxtaposed relation thereto on the belt feeder means 28 so as to be operative to sense the temperature of the belt feeder means 28, a second temperature detection means denoted by the reference numeral 76 in the drawing that is suitably mounted in juxtaposed relation thereto on the coal pipe 78 which in a conventional manner is cooperatively associated with the outlet 46 and through which the coal particles that have been pulverized to the desired fineness in the bowl mill 10 are transported in known fashion to the furnace whereat these coal particles provide the fuel for the furnace such that the second temperature detection means 76 is operative to sense the temperature within the coal pipe 78, a third temperature detection means denoted by the reference numeral 80 in the drawing that is suitably mounted in juxtaposed relation thereto on the exterior of the bowl mill 10 at the top thereof such as to be operative to sense the temperature within the bowl mill 10 at the top thereof, and a fourth temperature detection means denoted by the reference numeral 82 that is suitably mounted in juxtaposed relation thereto on the exterior of the bowl mill 10 at a position located below the grinding table 18 such as to be operative to sense the temperature within the bowl mill 10 below the grinding table 18. In accord with the best mode embodiment of the invention, the first temperature detection means 74, the second temperature detection means 76, the third temperature detection means 80 and the fourth temperature detection means 82 preferably each consist of a thermocouple of conventional construction. That is, any commercially available thermocouple that is suitable for use for purposes of detecting when a temperature reaches or exceeds a predetermined level in the manner described hereinabove and for generating a signal as an indication that a temperature has been reached or exceeded may be utilized as the first temperature detection means 74, the second temperature detection means 76, the third temperature detection means 80 and the fourth temperature detection means 82 in the fire extinguishing subsystem 14 of the combination inerting and fire extinguishing system of the present invention.

Upon detecting that the temperature being sensed thereby has reached or exceeded a predetermined level, each of the first, second, third and fourth temperature detection means 74, 76, 80 and 82, respectively, as stated hereinbefore is designed to be operative to generate a signal that is indicative of this fact; namely, that a temperature has reached or exceeded a predetermined level. This signal which is provided by the first, second, third and fourth temperature detection means 74, 76, 80 and 82, respectively, is in turn then transmitted to a receiving means, the latter being generally denoted by the reference numeral 84 in FIG. 6 of the drawing, to which each of the first, second, third and fourth temperature detection means 74, 76, 80 and 82 is suitably connected in circuit relation. More specifically, and as will be best understood with reference to FIG. 6 of the drawing, the first temperature detection means 74 as shown at 86 therein is suitably connected in circuit relation to the receiving means 84, the second temperature means 76 as shown at 88 therein is suitably connected in circuit relation to the receiving means 84, the third temperature detection means 80 as shown at 90 therein is suitably connected in circuit relation to the receiving means 84, and the fourth temperature detection means 82 as shown at 92 therein is suitably connected in circuit relation to the receiving means 84. The receiving means 84 upon receiving a signal from any one of the first, second, third and fourth temperature detection means 74, 76, 80 and 82, respectively, is designed to be operative to provide an audio and/or visual indication of the fact that a temperature has been sensed by one of the first, second, third and fourth temperature detection means 74, 76, 80 and 82, respectively, to have reached or exceeded a predetermined level. The audio indication provided by the receiving means 84 may, for example, take the form of an alarm sounding, etc., while the visual indication provided thereby by way of illustration may take the form of a light flashing, etc.

Any conventional form of audio and/or visual indicating means suitable for use for purposes of calling the attention of a plant operator to the fact that a temperature has been detected to have reached or exceeded a predetermined level by one of the plurality of temperature detection means, i.e., the first, second, third and fourth temperature detection means 74, 76, 80 and 82, respectively, may be employed in this connection. In addition, the receiving means 84 is designed to be operative also to itself generate a signal which in turn is intended to be transmitted to a valve control means, the latter being generally denoted by the reference numeral 94 in FIG. 6 of the drawing, to which the receiving means 84 is suitably connected in circuit relation as shown schematically at 96 in FIG. 6. To thus summarize, the receiving means 84 is intended to be operative to receive a signal from any one of the first, second, third and fourth temperature detection means 74, 76, 80 and 82, respectively, and in response to receipt thereby of such a signal is designed to be operative both to provide an audio and/or visual indication suitable for purposes of calling a plant operator's attention to the fact that such a signal has been received by the receiving means 84 from one of the plurality of temperature detection means, i.e., the first, second, third and fourth temperature detection means 74, 76, 80 and 82, respectively, with which the bowl mill 10 is suitably provided, and to generate a signal in response to receipt thereby of such a signal for transmission to the valve control means 94 for a purpose yet to be described. As such, the receiving means 84 may take the form of any suitable conventional type of controller device which presently is commercially available and which is capable of operating in the afore-described fashion.

Figure 4:
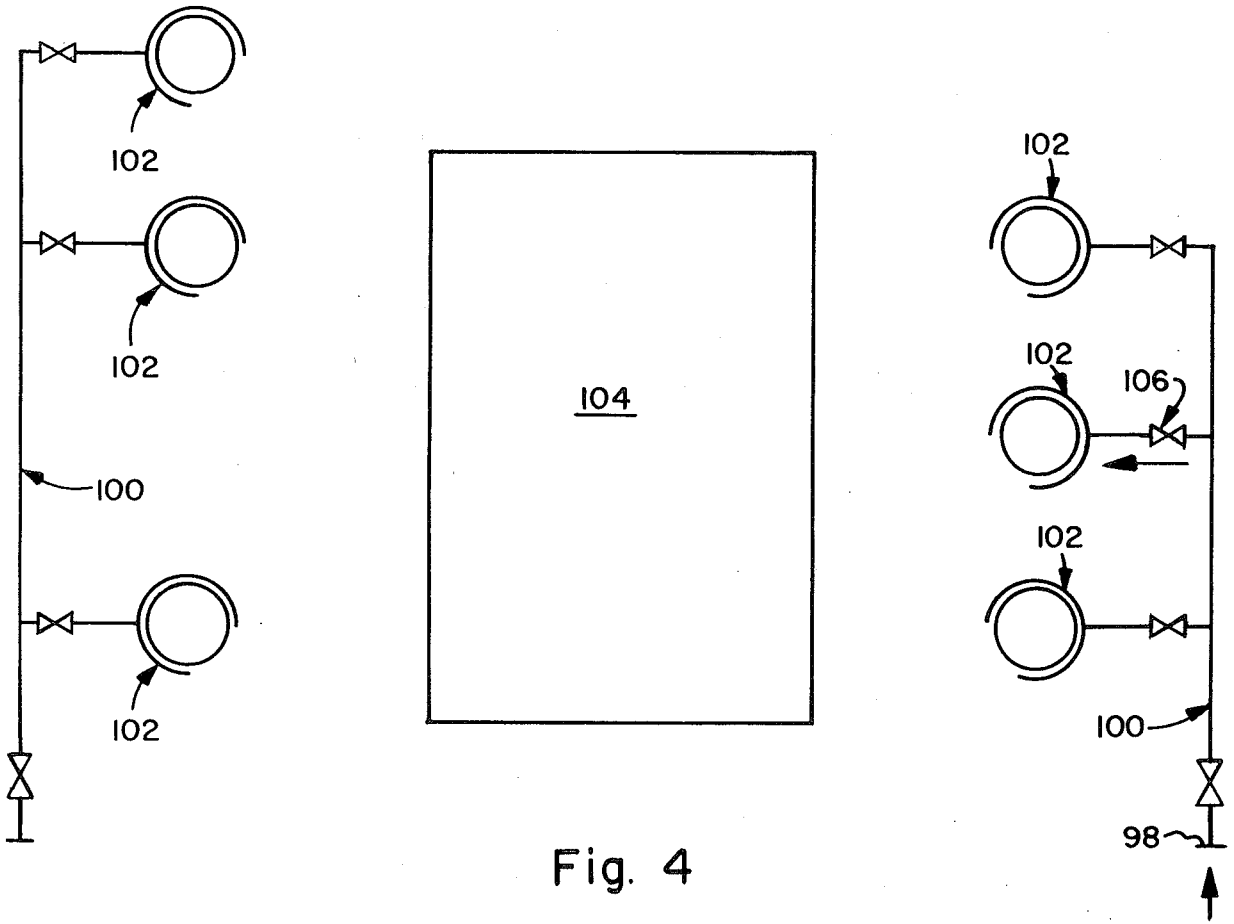
FIG. 4 is a schematic fluid flow diagram for the fire extinguishing subsystem segment of the combination inerting and fire extinguishing system constructed in accordance with the present invention illustrating the flow path that the fire extinguishing medium follows in flowing from the supply source of the fire extinguishing medium to the pulverizer bowl mill.
Figure 6:
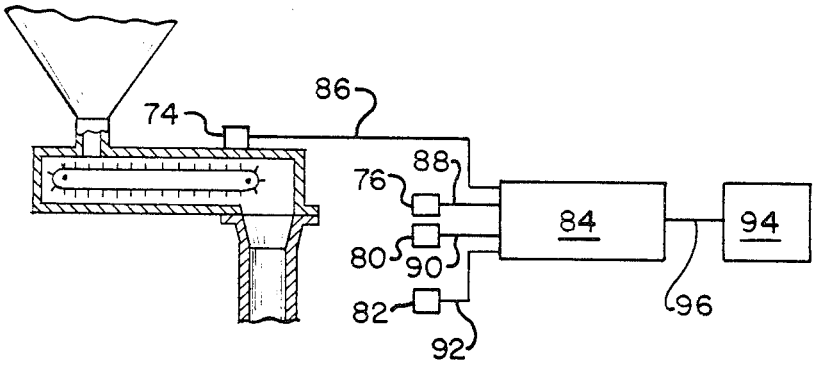
FIG. 6 is a schematic representation of the control portion of the fire extinguishing subsystem segment of the combination inerting and fire extinguishing system constructed in accordance with the present invention illustrating the manner in which the bowl mill and the supply source of the fire extinguishing medium are interconnected one to another for control purposes.

Continuing with the description of the fire extinguishing subsystem 14 constructed as depicted in FIGS. 2, 4 and 6 of the drawing, the fire extinguishing subsystem 14 in accord with the illustrated embodiment of the invention further includes a fire extinguishing medium supply source, the latter being depicted schematically at 98 in FIG. 4 of the drawing. In accord with the best mode embodiment of the invention, the fire extinguishing medium preferably consists of water. With further reference to FIG. 4 of the drawing, as depicted therein the source of supply of water which preferably is utilized as the fire extinguishing medium in accord with the best mode embodiment of the fire extinguishing subsystem 14 of the combination inerting and fire extinguishing system of the present invention is the water system, denoted generally by the reference numeral 100 in FIG. 4 of the drawing, of the plant in which the bowl mill 10 of FIGS. 1 and 2 functions as one of a multiplicity of bowl mills, each of the others being identified by the same reference numeral 102 in FIG. 4, that provide the pulverized coal which is employed as fuel in the furnace illustrated schematically as 104 in FIG. 4. Referring further to FIG. 4 of the drawing, it will be understood therefrom that the fire extinguishing medium, e.g., water, supply source 98 is connected by means of the piping depicted schematically in FIG. 4 of the plant water system 100 to a valve means, the latter being denoted generally in FIG. 4 by the reference numeral 106. The valve means 106 as will be discussed more fully hereinafter is suitably connected in circuit relation with the valve control means 94, to which reference has been had hereinbefore, such that the operation of the valve means 106 may be controlled by means of the valve control means 94.

Finally, reference will now be had to FIG. 2 of the drawing for purposes of completing the description of the nature of the construction of the fire extinguishing subsystem 14 of the combination inerting and fire extinguishing system of the present invention. As can be seen with reference to FIG. 2, the bowl mill 10 is designed to be provided with a multiplicity of fire extinguishing medium inlet means through which the fire extinguishing medium, e.g., water, when required can be injected into the interior of the bowl mill 10. To this end, in accord with the best mode embodiment of the invention the multiplicity of fire extinguishing medium inlet means with which the bowl mill 10 is designed to be equipped includes a pair of fire extinguishing medium inlet means each identified by the reference 108 in FIG. 2 that are suitably mounted in spaced relation to each other on the top of the bowl mill 10 within the inner cone of the classifier 38; three fire extinguishing medium inlet means, only one of which in the interest of maintaining clarity of illustration in the drawing is shown in FIG. 2, identified by the reference numeral 110 in FIG. 2 that are suitably mounted in spaced relation one to another on the separator body 16 of the bowl mill 10 above the plane of the grinding table 18; and four fire extinguishing medium inlet means, only two of which are shown in FIG. 2 in the interest of maintaining clarity of illustration therein, identified each by the reference numeral 112 in FIG. 2 that are suitably mounted in spaced relation one to another on the separator body 16 on the bowl mill 10 below the plane of the grinding table 18. All of the fire extinguishing medium inlet means, i.e., the fire extinguishing medium inlet means 108, the fire extinguishing medium inlet means 110 and the fire extinguishing medium inlet means 112 are connected in fluid flow relation by suitable piping to the valve means 106 shown in FIG. 4 of the drawing such that when the valve means 106 is in an open condition each of the fire extinguishing medium inlet means 108, 110 and 112 functions as a flow passage into the interior of the bowl mill 10 for the fire extinguishing medium, e.g., water.

A brief description will now be set forth herein of the mode of operation of both the inerting subsystem 12 and the fire extinguishing subsystem 14 of the combination inerting and fire extinguishing system of the present invention. To this end, consideration will first be given to the inerting subsystem 12 segment of the combination inerting and fire extinguishing system constructed in accordance with the present invention. With further reference thereto, the purpose of the inerting subsystem 12 is to reduce the potential for explosions in the bowl mill 10. In accord with the best mode embodiment of the invention, the inerting subsystem 12 is designed to operate automatically. The principal reason for this is that the transient conditions under which explosions in the bowl mill 10 take place sometimes occur too quickly for a manually operated system to respond in time. Preferably, the inerting medium which is utilized in the inerting subsystem 12 consists of steam provided that steam of the required quantity and enthalpy is available. However, during long periods of inerting or when steam is not available, an alternate form of inerting medium is designed to be employed. $CO_2$ and $N_2$ are each suitable for use in the inerting subsystem 12 as an alternative form of inerting medium. In those instances wherein $CO_2$ is being utilized as the inerting medium in the inerting subsystem 12, it is desirable that detectable means be made use of therewith for purposes of monitoring the presence of excessive levels of $CO_2$ concentration.

Basically, the inerting subsystem 12 is designed to be operative to perform two functions; namely, an inerting function and a bowl mill clearing function. The inerting function that the inerting subsystem 12 is designed to perform involves the injection of a low volume flow of inerting medium into the interior of the bowl mill 10 sufficient to maintain an inert atmosphere inside the bowl mill 10 when off-line during hazardous conditions. Whereas, the clearing function that the inerting subsystem 12 is designed to perform involves the injection of a high volume flow of inerting medium into the interior of the bowl mill 10 sufficient to safely transport the contents of the bowl mill 10 to the furnace 104 while maintaining an inert atmosphere in the bowl mill 10 during fire conditions or when restarting the bowl mill 10 after tripping while full of fuel, e.g., coal. The inerting function performed by the inerting subsystem 12 is initiated when certain specified hazardous conditions are found to exist. The hazardous conditions to which reference is had here include the following: when the bowl mill 10 containing fuel is off-line and is hot, wherein hot is defined as being when the outlet temperature of the bowl mill 10 is greater than or equal to 150° F.; when an interruption occurs in the flow of fuel to the bowl mill 10 while the outlet temperature thereof is greater than 129° F.; and when the bowl mill 10 is tripped while containing coal.

When the inerting function is initiated, the procedure followed by the inerting subsystem 12 includes, among others, the steps of: assuring that a flow path exists for the inerting medium from the bowl mill 10 to the furnace 104, that the inerting medium in the form of steam is injected into the interior of the bowl mill 10 through the inerting medium inlet means 72 at a rate sufficient to achieve an inert atmosphere within the bowl mill 10, that the bowl mill 10 and the belt feeder means 28 are both tripped if an interruption in the flow of coal from the belt feeder means 28 to the grinding table 18 has taken place, and that the belt feeder means 28 is tripped if the bowl mill 10 has been tripped. Next, the bowl mill 10 should be cleared in accordance with a procedure yet to be described herein of fuel, e.g., coal, at the first opportunity. Finally, if, thereafter, a restart of the bowl mill 10 is not possible, it is necessary to inject into the interior of the bowl mill 10 the alternate form of inerting medium, e.g., $CO_2$, while permitting the bowl mill 10 to cool to less than 150° F. whilst maintaining an inert atmosphere therewithin. This switch to steam from $CO_2$ as the inerting medium is accomplished in the following manner. The first step is to initiate the injection of $CO_2$ into the interior of the bowl mill 10 through the inerting medium inlet means 72. Then, the flow of steam into the interior of the bowl mill 10 through the inerting medium inlet means 72 is stopped. Once the temperature of the bowl mill 10 has reached less than 150° F. the next step is to clear the bowl mill of its contents, i.e., of fuel, e.g., coal. With the temperature of the bowl mill 10 being less than 150° F., it is then possible to clear the bowl mill of its contents manually, i.e., by hand.

Insofar as concerns the clearing function that the inerting subsystem 12 of the combination inerting and fire extinguishing system of the present invention is designed to perform, this function requires that the inerting subsystem 12 be capable of supplying steam in such quantities as to be able to transport the contents of the bowl mill 10 to the furnace 104 while maintaining an inert atmosphere within the bowl mill 10. There are two conditions which give rise to a need to make use of the clearing function capability of the inerting subsystem 12. One of these is where there is a need to clear the bowl mill 10 of raw fuel, e.g., coal, when the bowl mill 10 is off-line. The other is where there is a need to clear the bowl mill 10 and the fuel piping, which is cooperatively associated therewith, of raw fuel, e.g., coal, and burning raw fuel, e.g., coal, when there is a fire in the bowl mill 10.

With reference to effectuating the clearing of the bowl mill 10 when the latter is off-line, the best way to clear the bowl mill 10 of fuel, e.g., coal, is via a normal shutdown of the bowl mill 10. However, when a normal shutdown of the bowl mill 10 is not possible and the bowl mill 10 is tripped, clearing of the bowl mill 10 is accomplished by means of steam inerting in the manner which has been described herein previously. In either instance, though, the bowl mill 10 at the first opportunity needs to be cleared of its contents. Utilizing the clearing function capability of the inerting subsystem 12, the clearing procedure which is employed for purposes of clearing the bowl mill 10 of its contents includes, among others, the steps of: assuring that a flow path exists for the inerting medium from the bowl mill 10 to the furnace 104, and restarting the bowl mill 10 with steam as the transporting medium in sufficient quantities to transport the contents of the bowl mill 10 to the furnace 104 while maintaining an inert atmosphere within the bowl mill 10.

Consideration will next be given to the manner in which the clearing of the bowl mill 10 is accomplished when the bowl mill 10 is on fire. To this end, when a fire is detected in the bowl mill 10 or in one of the components associated therewith, both an inerting procedure and a fire extinguishing procedure are initiated. The fire extinguishing procedure to which reference is had here will be described subsequently in connection with the yet to be set forth herein description of the mode of operation of the fire extinguishing subsystem 14. On the other hand, the inerting procedure to which reference is had here essentially consists of the step of injecting steam at a rate sufficient to transport the contents of the bowl mill 10 to the furnace 104. Once the bowl mill 10 has been cleared of its contents, i.e., the bowl mill 10 is empty, the steam can be shut off and the bowl mill 10 following normal operating procedures can, once again, be placed into service.

In the event, however, that the bowl mill 10 cannot be cleared of its contents in the aforedescribed manner using steam, then the bowl mill 10 will require manual clearing. Normally, the existence of any of the conditions listed hereinafter will require that the bowl mill 10 be cleared manually, i.e., the bowl mill 10 has tripped with no restart possible, the inert clearing function is not operative or is nonexistent, or the inert clearing function is incapable of transporting the contents of the bowl mill 10 to the furnace 104. As mentioned previously herein, in order to effectuate the clearing of the bowl mill 10 manually the bowl mill 10 must be cooled to a temperature of less than 150° F. whereupon the bowl mill 10 can be entered for purposes of removing the contents of the bowl mill 10 therefrom.

Next, there will be set forth herein a brief description of the mode of operation of the fire extinguishing subsystem 14 of the combination inerting and fire extinguishing system constructed in accordance with the present invention. As a prelude thereto, however, a discussion will first be had herein of the types of fires that may occur in the bowl mill 10 and/or the components which are cooperatively associated therewith. In this regard, it is important for purposes of safety that there be early detection of fires. It is, therefore, desirable that the fire detection system be an automatic system, i.e., a system in which temperature indicator devices are utilized as the primary indication of the fact that a fire is in progress. Visual or other sensory means that are designed to be used by an individual to detect fires are characterized by the fact that they are arbitrary, slow and worst of all, require for their use that a person be present in the hazardous area itself. As a result, such visual or other sensory means are considered to be unsuitable for use for purposes of accomplishing the early detection of fires in the bowl mill 10 and/or the components which are cooperatively associated therewith.

As regards the bowl mill 10 and/or the components that are designed to be cooperatively associated therewith, the types of fires with which one must be concerned are five in number; namely, feeder fires, above bowl fires, under bowl fires, exhauster fires and fuel piping fires. Feeder fires are fires that are detected in the fuel, e.g., coal, in the raw fuel feeder, i.e., the belt feeder means 28. They can be detected with a temperature detection device, i.e., the first temperature detection means 74, mounted on the belt feeder means 28 in juxtaposed relation thereto. Fires in this area may also be recognized during routine inspection based on an observance of paint peeling from the belt feeder means 28 and connecting piping.

Above bowl fires are fires detected in the area above the grinding table 18 within the bowl mill 10. They can be detected with temperature detection devices, i.e., the third temperature detection means 80, mounted on the top of the bowl mill 10 in juxtaposed relation thereto. Fires in this area may also be recognized during routine inspection based on an observance of paint peeling from the separator body 16 of the bowl mill 10.

Under bowl fires are fires detected in the area under the grinding table 18 within the bowl mill 10 or inside the primary air duct 40 that is connected to the bowl mill 10. They can be detected with temperature detection devices, i.e, the fourth temperature detection means 82, mounted on the bowl mill 10 below the plane of the grinding table 18. Fires in this area may also be recognized during routine inspection based on an observance of paint peeling from the bowl mill air inlet duct 40, sparks discharging from the pyrite hopper, or a marked reduction in the hot air necessary to maintain the outlet temperature of the bowl mill 10.

Exhauster fires are fires detected within the exhauster. They can be detected with temperature detection devices, i.e., the second temperature detection means 76, mounted downstream of the outlets 46 of the bowl mill 10. Fires in this area may also be recognized during routine inspection based on an observance of paint peeling from the exhauster casing.

Fuel piping fires are fires detected within the fuel piping, e.g., coal pipe 78. They can be detected with temperature detection devices, i.e., the second temperature detection means 76, mounted on the coal pipe 78 in juxtaposed relation thereto. Fires in this area may also be recognized during routine inspection based on an observance of paint peeling from the fuel piping, e.g., coal pipe 78.

Continuing with the description of the mode of operation of the fire extinguishing subsystem 14 of the combination inerting and fire extinguishing system of the present invention, upon detection of the existence of hazardous conditions audio and/or visual alarms shall be activated. To this end, such alarms shall be activated automatically as a result of operation of the receiving means 84 upon detection, among others, of any of the following hazardous conditions: the first temperature detection means 74 mounted in juxtaposed relation to the belt feeder means 28 measures a temperature equal to or above a maximum value, the second temperature detection means 76 mounted in juxtaposed relation to the coal pipe 78 measures a temperature equal to or above a maximum value, the third temperature detection means 80 mounted on the top of the bowl mill 10 measures a temperature equal to or above a maximum value, the fourth temperature detection means 82 mounted on the bowl mill 10 below the plane of the grinding table 18 measures a temperature equal to or above a maximum value. Such alarms, i.e., the audio and visual alarms referred to hereinabove, shall be capable of being manually initiated at any time. In addition, such alarms will be manually initiated when either of the two following conditions occur: when the bowl mill 10 is started and when the bowl mill 10 is shut down. Furthermore, the alarms shall remain activated until all automatic initiating signals are absent and shall only be deactivated manually by the plant operator. Finally, manual alarm initiation shall require manual shut off.

For purposes of completing the description of the mode of operation of the fire extinguishing subsystem 14 of the combination inerting and fire extinguishing system of the present invention, there will not be set forth herein a discussion of the procedures by which the fire extinguishing function thereof is accomplished therewith. To this end, in the case of feeder fires, upon the detection thereof, a fire extinguishing medium, e.g., water, is injected into the raw fuel feed, i.e., the belt feeder means 28, such that no burning fuel is permitted to enter the bowl mill 10. Water is also injected into the bowl mill 10 under the grinding table 18, above the grinding table 18, and in the areas of the classifier 38 and the exhauster by means of the fire extinguishing medium inlet means 108, 110 and 112. Simultaneous with the injection of the water, the operation of the bowl mill 10 is changed from that of one wherein the coal particles are transported through the bowl mill 10 by means of air to one wherein they are transported therethrough by means of a high inerting flow of an inerting medium, e.g., steam. In addition, the belt feeder means 28 is tripped. When the bowl mill 10 has been emptied of its contents, the injection of water both under and above the grinding table 18 as well as in the areas of the classifier 38 and the exhauster is stopped, and the bowl mill 10 is shut off and isolated. However, the water injection into the belt feeder means 28 is continued until all evidence of the feeder fire has disappeared.

On the other hand, in the case of under bowl/above bowl/exhauster/fuel pipe fires, upon the detection thereof the operation of the bowl mill 10 is changed from that of one wherein the coal particles are transported through the bowl mill 10 by means of air to one wherein they are transported therethrough by means of a high inerting flow of an inerting medium, e.g., steam. In addition, the raw fuel feeder, i.e., the belt feeder means 28, is tripped. Also, simultaneous with the change from air transporting of the coal particles to the steam transporting thereof, water is injected into the bowl mill 10 under the grinding table 18, above the grinding table 18, and in the areas of the classifier 38 and the exhauster by means of the fire extinguishing medium inlet means 112, 110 and 108. When the bowl mill 10 has been emptied of its contents, the bowl mill 10 is shut off and isolated. However, the injection of water into the interior of the bowl mill 10 is continued until all evidence of the fire has disappeared.

Continuing, if a fire is detected in the bowl mill 10 when tripped, water is injected into the bowl mill 10 simultaneous with the inerting thereof. More specifically, water is injected into the bowl mill 10 under the grinding table 18, above the grinding table 18 and in the areas of the classifier 38 and the exhauster. This injection of water continues until all evidence of the fire has disappeared. Thereafter, the bowl mill 10 is cleared of its contents as quickly as possible.

With respect to the injection of water into the bowl mill 10, the water is designed to be introduced thereinto in such quantities and at such locations as to not cause pluggage or interruption of the flow of coal to the bowl mill 10 and as to not stir up any deposits of combustible material in the bowl mill 10. Moreover, water is injected into the bowl mill 10 in such quantities as to extinguish the fire. Lastly, when all evidence of the fire has disappeared the water is shut off and the bowl mill is tripped and isolated.

There has now been described hereinbefore the procedure that is utilized for fire extinguishing purposes when the inerting subsystem 12 of the combination inerting and fire extinguishing system of the present invention is operational. However, if the inerting subsystem 12 is not functioning or is nonexistent, the manner in which the fire extinguishing subsystem 14 is employed for purposes of extinguishing a fire is as follows. In the case of a feeder fire, upon the detection thereof, the fire extinguishing medium, e.g., water, is injected into the raw fuel feed, i.e., the belt feeder means 28, such that no burning fuel, e.g., coal, is permitted to enter the bowl mill 10. Water is also injected into the bowl mill 10 under the grinding table 18, above the grinding table 18, and in the areas of the classifier 38 and the exhauster. This injection of water continues until all evidence of the fire has disappeared. After the fire has been extinguished and the injection of water has ceased, the bowl mill 10 is cleared of its contents manually, since the clearing function capability of the inerting subsystem 12 is inoperative.

On the other hand, in the case of under bowl/above bowl/exhauster fires, upon the detection thereof, the following actions are made to occur simultaneously: the hot air to the bowl mill 10 is shut off, the cold air damper (not shown) of the bowl mill 10 is opened to maintain 100% air flow, and water is injected into the bowl mill 10 under the grinding table 18, above the grinding table 18, and in the areas of the classifier 38 and the exhauster. Also, the feed of coal from the belt feeder means 28 is continued at a high rate. Until all evidence of the fire has disappeared, the injection of water into the interior of the bowl mill 10 is made to continue. Finally, after the fire has been extinguished and the injection of water has ceased, the bowl mill 10 is cleared of its contents manually.

Continuing, in the case of a fuel pipe fire with the inerting subsystem 12 being nonfunctioning or nonexistent, upon the detection of such a fire, water is injected into the bowl mill 10 under the grinding table 18, above the grinding table 18, and in the areas of the classifier 38 and the exhauster. In addition, the following actions are also taken: the hot and cold air to the bowl mill 10 are shut off, the flow of coal from the belt feeder means 28 is stopped, and the barrier valves (not shown) at the outlets 46 of the bowl mill 10 are closed. The injection of water is made to continue until all evidence of the fire has disappeared. Lastly, after the fire has been extinguished and the injection of water has ceased, the bowl mill 10 is cleared of its contents manually.

To thus summarize, the injection of the water into the bowl mill 10 is initiated upon the indication of a fire being given by the first, second, third or fourth temperature detection means 74, 76, 80 and 82, respectively. Moreover, the water is designed to be introduced into the bowl mill 10 in such quantities and at such locations as to not cause pluggage or interruption of the flow of coal to the bowl mill 10 and to not stir up any deposits of combustible material in the bowl mill 10. Also, the water is injected into the bowl mill 10 in such quantities as to extinguish the fire. Lastly, when all evidence of the fire has disappeared, the water is shut off and the bowl mill 10 is tripped and isolated.

Thus, in accordance with the present invention there has been provided a new and improved inerting subsystem suitable for use in a bowl mill of the type that is operative for purposes of effecting the pulverization of a material such as coal. Moreover, there is provided in accord with the present invention a new and improved fire extinguishing subsystem that is suitable for use in combination with the subject inerting subsystem in a bowl mill of the type that is operative for purposes of effecting the pulverization of a material such as coal. Also, in accordance with the present invention the subject combination inerting and fire extinguishing system which is particularly suited for use in a bowl mill embodies a continuous purging means that is operative during any inerting sequence to cause an inerting medium to flow continually through the bowl mill so as to ensure that there is no buildup of volatile gases within the bowl mill. Further, the subject combination inerting and fire extinguishing subsystem of the present invention which is particularly suited for use in a bowl mill embodies a backup inerting means that is operative to provide $CO_2$ inerting when the primary steam inerting system is either not available or for some other reason cannot be utilized. In addition, in accordance with the present invention the subject combination inerting and fire extinguishing system which is particularly suited for use in a bowl mill embodies a bowl mill clearing means that is operative after the bowl mill has been taken off-line to clear the bowl mill of its contents via a steam flow so as to render the bowl mill ready for restart. Furthermore, the subject combination inerting and fire extinguishing system of the present invention which is particularly suited for use in a bowl mill embodies a water injection fire suppression means that is operative in the event of a fire in the fuel preparation system to accomplish the injection thereinto of water simultaneous with a steam clearing of the interior of the bowl mill. Additionally, in accordance with the present invention the subject combination inerting and fire extinguishing system which is particularly suited for use in a bowl mill is capable of either manual operation or automatic operation. Penultimately, the subject combination inerting and fire extinguishing system of the present invention is suitable for employment in newly constructed bowl mills as well as being equally suitable for employment in retrofit applications. Finally, in accordance with the present invention the subject combination inerting and fire extinguishing system which is particularly suited for use in a bowl mill is advantageously characterized both by its ease of manufacture and its ease of installation in a bowl mill, while yet being relatively inexpensive to provide.

While only one embodiment of our invention has been shown, it will be appreciated that modifications thereof, some of which have been alluded to hereinabove, may still be readily made thereto by those skilled in the art. We, therefore, intend by the appended claims to cover the modifications alluded to herein as well as all the other modification which fall within the true spirit and scope of our invention.

What is claimed is:

1. In a bowl mill having a substantially closed separator body, a rotatable grinding surface mounted for rotation in a first direction within the separator body and upon which pulverization of material is effected, material supply means supported within the separator body for supplying material to be pulverized to the grinding surface and having a first portion projecting outwardly of the separator body, outlet means supported on the separator body for discharging from the bowl mill material that has been pulverized therewithin, and air inlet means for supplying air to the interior of the separator body for transporting material that has been pulverized on the grinding surface therefrom to the outlet means for discharging from the bowl mill, the improvement of a combination inerting and fire extinguishing system comprising:

(a) an inerting subsystem operative for establishing an inert atmosphere within the separator body as well as for clearing material from the bowl mill, said inerting subsystem including inerting inlet means connected to the air inlet means for supplying an inerting medium through the air inlet means to the interior of the bowl mill, a primary inerting medium supply means connected in fluid flow relation to said inerting inlet means and operative for supplying a primary inerting medium to said inerting inlet means and therefrom to the air inlet means and therethrough into the interior of the bowl mill, a backup inerting medium supply means connected in fluid flow relation to said inerting inlet means and operative for supplying a backup inerting medium to said inerting inlet means and therefrom to the air inlet means and therethrough into the interior of the bowl mill, a no material flow detection means suitably mounted on the first portion of the material supply means so as to be located externally of the separator body of the bowl mill, said no material flow detection means being operative when the bowl mill is in operation to detect the absence of material flow in the material supply means and to provide a signal indication of such a lack of material flow in the material supply means, a receiving means connected in circuit relation with said no material flow detection means for receiving the signal generated thereby, said receiving means being operative upon receiving a signal from said no material flow detection means to provide an indication of the receipt thereof and a control means connected to said receiving means for receiving the signal therefrom, said control means further being connected in fluid flow relation with said primary inerting medium supply means so as to be operative upon receipt of the signal from said receiving means for initiating the flow of the primary inerting medium to said inerting inlet means and therefrom to the air inlet means and therethrough to the interior of the bowl mill when a lack of material flow in the material supply means is detected by said no material flow detection means, said control means further being connected in fluid flow relation with said backup inerting medium supply means so as to be operative upon receiving the signal from said receiving means for initiating the flow of the backup inerting medium to said inerting inlet means and therefrom to the air inlet means and therethrough to the interior of the bowl mill when said primary inerting medium supply is inoperative; and (b) a fire extinguishing subsystem operative for effectuating a reduction in temperature within the interior of the bowl mill.

2. In a bowl mill, the improvement of a combination inerting and fire extinguishing system as set forth in claim 1 wherein the indication provided by said receiving means upon receiving a signal from said no material flow detection means is an audio indication.

3. In a bowl mill, the improvement of a combination inerting and fire extinguishing system as set forth in claim 1 wherein the indication provided by said receiving means upon receiving a signal from said no material flow detection means is a visual indication.

4. In a bowl mill, the improvement of a combination inerting and fire extinguishing system as set forth in claim 1 wherein the primary inerting medium is steam.

5. In a bowl mill, the improvement of a combination inerting and fire extinguishing system as set forth in claim 4 wherein the backup inerting medium is $CO_2$.

6. In a bowl mill, the improvement of a combination inerting and fire extinguishing system as set forth in claim 1 wherein said fire extinguishing subsystem includes a first fire extinguishing inlet means provided on the upper portion of the separator body so as to be operative for injecting fire extinguishing medium into the interior of the separator body through the upper portion thereof, a second fire extinguishing inlet means provided on the side portions of the separator body so as to be operative for injecting fire extinguishing medium into the interior of the separator body through the side portions thereof, a third fire extinguishing inlet means provided on the lower portion of the separator body so as to be operative for injecting fire extinguishing medium into the interior of the separator body through the lower portion thereof, a first temperature detection means positioned on the first portion of the material supply means so as to be operative to detect when the temperature within the first portion of the material supply means reaches or exceeds a predetermined level and to provide a signal as an indication thereof, a second temperature detection means positioned on the upper portion of the separator body so as to be operative to detect when the temperature within the upper portion of the separator body reaches or exceeds a predetermined level and to provide a signal as an indicative thereof, a third temperature detection means positioned on the lower portion of the separator body so as to be operative to detect when the temperature within the lower portion of the separator body reaches or exceeds a predetermined level and to provide a signal as an indication thereof, a fourth temperature detection means positioned on the outlet means so as to be operative to detect when the temperature within the outlet means reaches or exceeds a predetermined level and to provide a signal as an indication thereof, a receiving means connected in circuit relation with each of said first, second, third and fourth temperature detection means for receiving therefrom the signal generated thereby, said receiving means being operative upon receiving such a signal to provide an indication of the receipt thereof, and a control means connected to said receiving means for receiving the signal therefrom, said control means further being connected to fluid flow relation to each of said first, secnd and third fire extinguishing supply means so as to be operative upon receipt of the signal from the said receiving means for initiating the flow of fire extinguishing medium to each of said first, second and third fire extinguishing inlet means and therethrough into the interior of the bowl mill so as to effectuate a reduction in the level of the temperature that occasioned a need for the flow of fire extinguishing medium into the interior of the bowl mill.

7. In a bowl mill, the improvement of a combination inerting and fire extinguishing system as set forth in claim 6 wherein the fire extinguishing medium is water.

8. In a bowl mill, the improvement of a combination inerting and fire extinguishing system as set forth in claim 7 wherein the indication provided by said receiving means upon receiving such a signal is an audio indication.

9. In a bowl mill, the improvement of a combination inerting and fire extinguishing system as set forth in claim 7 wherein the indication provided by said receiving means upon receiving such a signal is a visual indication.

* * * * *